US005867876A

United States Patent [19]

Petersen

[11] Patent Number: 5,867,876

[45] Date of Patent: Feb. 9, 1999

[54] MALE-TO-MALE CONNECTOR APPARATUS HAVING SYMMETRICAL AND UNIFORM CONNECTOR MATRIX

[76] Inventor: Edward C. Petersen, 43 John St., Cranford, N.J. 07016

[21] Appl. No.: 854,850

[22] Filed: May 12, 1997

[51] Int. Cl.[6] ..... A44B 18/00

[52] U.S. Cl. ..... 24/452; 24/442; 24/447

[58] Field of Search ..... 24/306, 442–452, 24/575–577

[56] References Cited

U.S. PATENT DOCUMENTS

| | | | |
|---|---|---|---|
| 3,101,517 | 8/1963 | Fox et al. . | |
| 3,266,113 | 8/1966 | Flanagan . | |
| 3,408,705 | 11/1968 | Kayser et al. . | |
| 3,597,874 | 8/1971 | Ogsburg . | |
| 3,603,025 | 9/1971 | Heubl . | |
| 3,955,245 | 5/1976 | Ballin . | |
| 4,147,007 | 4/1979 | Eppich . | |
| 4,290,174 | 9/1981 | Kalleberg . | |
| 4,531,733 | 7/1985 | Hall . | |
| 4,860,896 | 8/1989 | Snider . | |
| 4,946,527 | 8/1990 | Battrell | 24/444 X |
| 5,040,275 | 8/1991 | Eckhardt et al. | 24/442 X |
| 5,077,870 | 1/1992 | Melby et al. | 24/452 |
| 5,097,570 | 3/1992 | Gershenson . | |
| 5,201,101 | 4/1993 | Rouser et al. . | |
| 5,212,853 | 5/1993 | Kaneko . | |
| 5,586,372 | 12/1996 | Eguchi et al. | 24/452 |
| 5,596,794 | 1/1997 | Shibanushi | 24/452 |
| 5,625,929 | 5/1997 | Hattori et al. | 24/452 |
| 5,691,021 | 11/1997 | Kobe | 24/442 X |

*Primary Examiner*—James R. Brittain
*Assistant Examiner*—Robert J. Sandy
*Attorney, Agent, or Firm*—Lawrence C. Chasin

[57] ABSTRACT

A separable plastic male-to-male connector includes a pair of connector units each having a planar base and a plurality of protrusions extending outward from the base and being oriented on the base so as to form a matrix. The matrix has a plurality of lateral and longitudinal rows wherein a distance $C_{L1}$ is between centers of laterally adjacent male protrusions, and wherein a distance $C_{L2}$ is between centers of longitudinally adjacent male protrusions. Each protrusion includes a head portion and a stem portion. The head portion has a height $K_H$ equal to $0.50*(C_{L1}+C_{L2})/2$ and a diameter $K_D$ equal to $0.75*(C_{L1}+C_{L2})/2$. The stem portion has a first end attached to the base and a second opposed end attached to the head portion. The stem portion has a height $S_H$ equal to $0.63*(C_{L1}+C_{L2})/2$ and a diameter $S_D$ equal to $0.56*(C_{L1}+C_{L2})/2$. $C_{L1}$, $C_{L2}$, $K_H$, $K_D$, $S_H$, and $S_D$ each have a tolerance of ±6%. The total combined tolerance for $C_{L1}$, $C_{L2}$, $K_H$, $K_D$, $S_H$, and $S_D$ taken together is no more than ±6%.

19 Claims, 2 Drawing Sheets

MALE-TO-MALE CONNECTOR APPARATUS HAVING SYMMETRICAL AND UNIFORM CONNECTOR MATRIX

BACKGROUND OF THE INVENTION

The present invention relates to a connector apparatus, and more particularly, to a male-to-male connector apparatus having a symmetrical and uniform connector matrix which has broad application in a variety of fields, arts and technologies.

There are generally two types of modular interlocking connector apparatuses: male-to-female connector matrices and male-to-male connector matrices. The former are disadvantages for numerous reasons including the need to properly orient and align the male and female parts, the added costs of having different manufacturing equipment and technique for the male and female parts, and the aesthetic differences. Male-to-male connectors alleviate the problems of the male-to-female connectors.

Male-to-male connectors are well known in many arts and have been for a long time. Male-to-male connectors typically employ a first male connector matrix removably attachable to a second male connector matrix. The first and second male connector matrices are typically identical. Each matrix typically includes a plurality of male protrusions extending from a base member. Furthermore each male protrusion typically includes a stem attached to the base member and a wider head section attached to the stem opposite the base member. The matrix arrangement of the male protrusions is designed so that the head section of each protrusion on the first male connector is removably engageable with the male protrusions of the second connector matrix and vice versa. The shape and placement of the male connectors on the base surface must be done to exacting specifications in order to achieve proper alignment and engagement. Accordingly, there are many possible dimensions and shapes which the male protrusions may have as evidenced by, for example, U.S. Pat. Nos. 5,212,853; 5,201,101; 5,097,570; 4,147,007; 4,290,174; 3,955,245; 3,266,113; and 3,101,517. There is a continuing desire to create a male-to-male connector matrix which provides more secure engagement, easier disengagement, less shear or movement in the lateral direction when engaged, and broader application due to its look and feel.

SUMMARY OF THE INVENTION

A separable plastic male-to-male connector includes a pair of connector units each having a planar base and a plurality of protrusions extending outward from the base and being oriented on the base so as to form a matrix. The matrix has a plurality of lateral and longitudinal rows wherein a distance $C_{L1}$ is between centers of laterally adjacent male protrusions, and wherein a distance $C_{L2}$ is between centers of longitudinally adjacent male protrusions. Each protrusion includes a head portion and a stem portion. The head portion has a height $K_H$ equal to $0.50*(C_{L1}+C_{L2})/2$ and a diameter $K_D$ equal to $0.75*(C_{L1}+C_{L2})/2$. The stem portion has a first end attached to the base and a second opposed end attached to the head portion. The stem portion has a height $S_H$ equal to $0.63*(C_{L1}+C_{L2})/2$ and a diameter $S_D$ equal to $0.56*(C_{L1}+C_{L2})/2$. $C_{L1}$, $C_{L2}$, $K_H$, $K_D$, $S_H$, and $S_D$ each have a tolerance of ±6%. The total combined tolerance for $C_{L1}$, $C_{L2}$, $K_H$, $K_D$, $S_H$, and $S_D$ taken together is no more than ±6%.

The head has a top section $K_T$ and a bottom section $K_B$. The top section $K_T$ has a height of $0.37*(C_{L1}+C_{L2})/2\pm6\%$ and the bottom section $K_B$ has a height of $0.13*(C_{L1}+C_{L2})/2\pm6\%$.

In one embodiment a stem support flange is attached to the base around the first end of each stem portion. The stem support flange has a height $F_H$ of $0.13*(C_{L1}+C_{L2})/2\pm6\%$, and a diameter $F_D$ of $0.75*(C_{L1}+C_{L2})/2\pm6\%$.

DETAILED DESCRIPTION OF THE PREFERRED EMBODIMENTS

Figure 1:
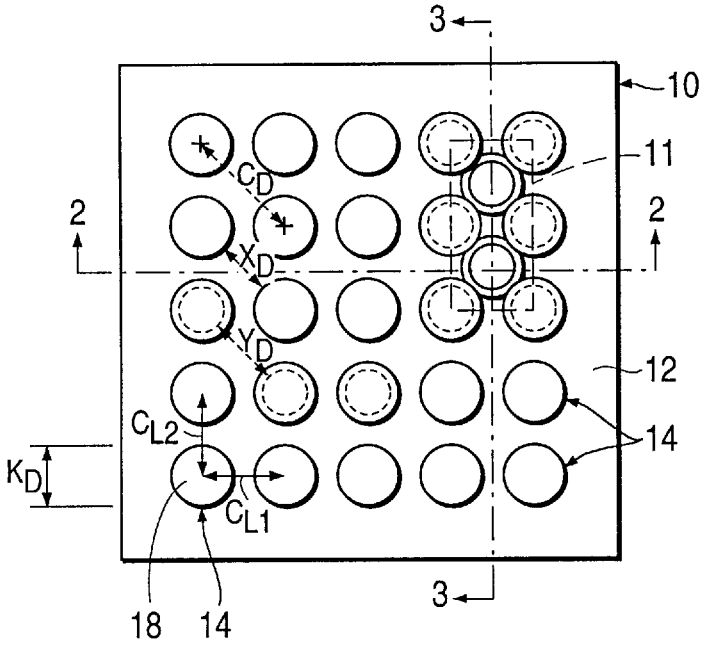
FIG. 1 is a top plan view of the connector apparatus according to the teachings of the present invention.
Figure 2:
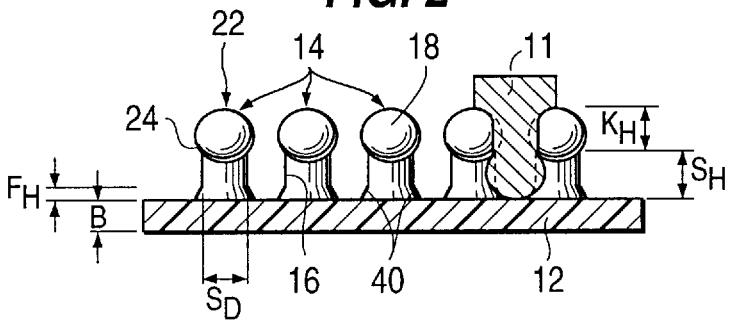
FIG. 2 is a sectional view taken along line 2—2 of FIG. 1.
Figure 3:
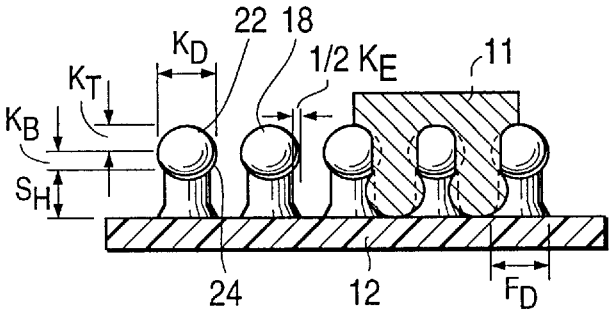
FIG. 3 is a sectional view taken along line 3—3 of FIG. 1.

FIGS. 1–3 illustrate a male-to-male connector matrix 10 according to the present invention. While only a section of the second matrix 11 is shown in the Figures, it is desirable to use an enlarged second matrix of generally the same size and dimensions as the matrix 10 when the invention is used as a connector. The matrix 10 includes a base 12 and a plurality of male protrusions 14 extending outward therefrom. The plurality of male protrusions 14 are arranged in a plurality of lateral and longitudinal rows on the base 12. The center-to-center distance $C_{L1}$ is between laterally adjacent male protrusions and the center-to-center distance $C_{L2}$ is between longitudinally adjacent male protrusion. Preferably, the center-to-center distances $C_{L1}$, and $C_{L2}$ are the same (hereinafter designated $C_L$) and at a right angle to each other so that the center-to-center distance $C_D$ between diagonally adjacent male protrusions is $1.41*(C_{L1}+C_{L2})/2$ or, in other words, $1.41*C_L$. These dimensions are ideal dimensions and there can be a slight tolerance as explained below.

The base 12 can be flexible or non-deforming. In addition, the base 12 can be constructed from the same or different material as the male protrusions 14. The base thickness B must be greater than or equal to $0.37*C_L$ to withstand the elastic deformations during engagement and disengagement of the matricies to each other. The base thickness does not have to be restricted to the homogeneous material of the matrix, provided that it is supported or attached to another surface so that the equivalent base thickness remains greater than or equal to $0.37*C_L$.

Referring specifically to FIGS. 2 and 3, each male protrusion 14 includes a stem 16 and a head 18. The stem 16 is preferably cylindrical wherein a first end is attached to the base 12 and a second end is attached to the head 18. The stem 16 and/or head 18 may be hollow or solid. The stem height $S_H$ is $0.63*C_L$. The stem diameter$_D$S is 0.56*C. These dimensions are ideal dimensions and there can be a slight tolerance as explained below.

The head 18 is preferably a pseudo-spherically smooth and uniform knob having a top section 22 and a bottom section 24. The head diameter $K_D$ is $0.75*C_L$. The head height $K_H$ is $0.50*C_L$. The height $K_T$ of the top section 22 of the head is $0.37*C_L$, while the height $K_B$ of the bottom section 24 of the head is $0.13*C_L$. The smooth rounded surface of the top section 22 of the head facilitates engagement of the protrusions 14 of opposed connectors to each other. The smooth rounded surface of the bottom section 24 of the head facilitates disengagement of the opposed protrusions 14 from each other and provides for a snugger "fit"

when the protrusions of opposed connectors are engaged. It is this particular shape of the head 18 in combination with the stem height and stem diameter which provides the secure engagement and the unique tactile sensation when engaging and disengaging the connector of the present invention. In this embodiment the diameter of the engagement portion of the head $K_E$ which contacts the heads of the opposed male protrusions on the opposed connector is defined as follows:

$$K_E=K_D-S_D=0.75*C_L-0.56*C_L=0.19*C_L$$

The engaging lip which extends out over the stem, extends a distance of ½* $K_E$. These dimensions are also ideal dimensions and there can be a slight tolerance as explained below.

When engaging two connectors according to the invention, each male protrusion 14 is inserted with the head 18 directed downward and deformed into a retaining space 30 defined by four adjacent male protrusions 14 of the other connector arranged in two adjacent lateral rows and two adjacent longitudinal rows, with the heads 18 directed upward. Thus, the downward directed head 18 of the first connector frictionally contacts the heads 18 and stems 16 of the opposed protrusions 14 on the second connector. It follows that the placement of the male protrusions 14 in forming the matrix and the specific dimensions of the head 18 and stem 16 are such that $X_D<K_D<Y_D$, wherein $X_D$ is the diagonal distance between heads 18, $K_D$ is the head diameter, and $Y_D$ is diagonal distance between stems 16.

However, it is the specific mathematical equations above for the dimensions of the stems 16 and knobs 18 which provides a unique tactile sensations when engaging and disengaging the two connectors. This tactile sensation is described as follows: When pushing two opposing connector pieces 10 and 11 together, the heads 18 on one connector cause temporary elastic deformation to occur to the heads on the opposed connector, literally spreading them apart so that the heads pass by each other. Engagement is accomplished not all at once simultaneously along the entire surface of the connector; but rather, downward along a length of the connector from the first point of pressure. Once the outer head edges $K_E$ have passed each other, they slide or "relax" into the retaining space 30 and resiliently resume their original elastic state to lock the two connectors together. The diagonal distance $Y_D$ between the stems 16 is calculated to be just slightly larger than the knob diameter $K_D$ to virtually eliminate side-to-side "play". Vertical play is also virtually eliminated since the stem height $S_H$ is just slightly larger than the knob height $K_H$.

The virtual elimination of both horizontal and vertical play results in a much stronger connector capable of supporting more weight. Additionally, since the stem diameter $S_D$ is 75% of the head diameter $K_D$ (i.e. $S_D=0.75*K_D$), this provides strength to prevent stem or knob breakage during engagement or disengagement of the two connectors. Disengagement of the two connectors provides the same tactile sensation in reverse. There is again a step-like sensation as the heads 18 again are forced past each other.

A stem support flange 40 is provided around the first end of the stem 16 to more firmly secure the stem 16 to the base 12 and to make to the retaining space 30 tighter and more secure. The added securement provided by the stem support flange 40 also facilitates a smoother, cleaner, stronger and easier pull from the fabrication process. The height FH of the stem support flange 40 is $0.13*C_L$. The diameter $F_D$ of the stem support flange 40 is $0.75*C_L$. These dimensions are also ideal dimensions and there can be a slight tolerance.

The allowed tolerance for all of the dimensions of the heads 18, stems 16, support flange 40 and the placement thereof on the base surface 12 is ±6% for all dimensions. However, the invention will only function properly and provide the unique tactile sensation during engagement and disengagement if the total percentage variation of all components is no greater than ±6%. For example, three variables may be varied ±2.0% or four variables may be varied ±1.5%, or one variable ±5% with another ±1% and the invention will still provide the unique tactile sensation.

The specific dimensions of the connector still depend on the application. For example, as a connector it is possible to have $C_L$=0.125 inch. Conversely, as the platform for a children's toy building block system it may be desirable to have $C_L$=0.50 inch.

The connector matrix 10 is preferably constructed from a plastic compound which exhibits elastic deformation characteristics which optimize engagement and disengagement of the pair of connector matrices. Once engaged it is desirable for the connector matrices both to not move and be rigid with respect to each other unless a force is applied perpendicular between the bases. The force in this direction alone should require minimal effort to separate the connector matrices. Depending on the application, rubberizing agents may be added to increase "peel" characteristics. For example, if the connector matrix 10 is used to wall mount a telephone (somewhat heavy with infrequent engagement and disengagement) it would be desirable to have very little peel, thus little to no rubberizing agents. Conversely, if the connector matrix 10 is used to mount a cellular phone to the dashboard of a car (lighter weight and more frequent engagement and disengagement), then additional rubberizing agents would be necessary.

A variety of thermoplastic resins may be used to manufacture the connector matrix 10 depending on the application. Polyethylene, polypropelene, polystyrene, polyvinyl chloride or compounds made of these resins could provide the necessary rigidity, tactile feel and subtle flexibility required to optimize the invention. Other resins exhibiting the desirable characteristics may also be used.

While several manufacturing methods may be used to make the invention, the preferred method is a combination of injection molding and injection blow molding. More specifically, the base 12 and/or the base 12 and stems 16 are made using injection molding. The knobs 18 and/or the knobs 18 and stems 16 are made using injection blow molding. A fusion process with a combination of electronic heat sealing and/or adhesive is used to attach the knobs 18 and/or knobs 18 and stems 16 to the base 12 and stems 16 and/or base 12, respectively.

Figure 4A:
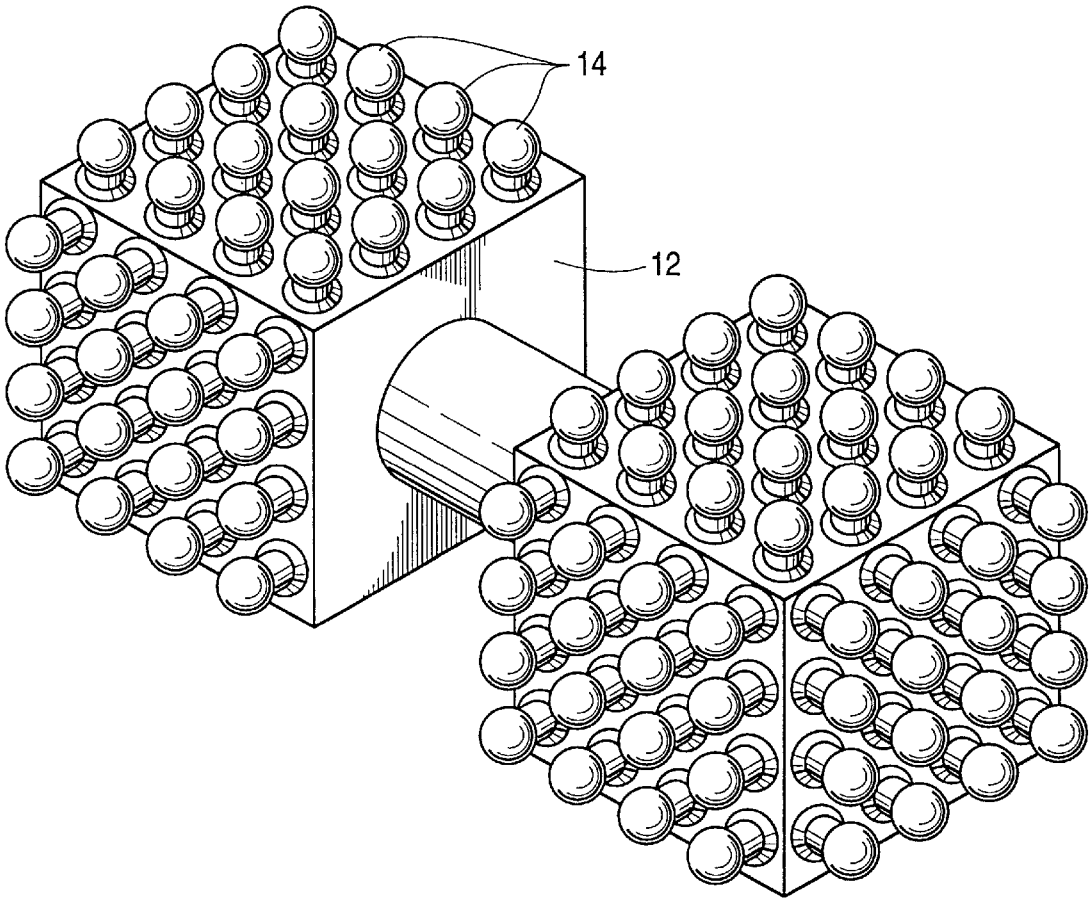
FIGS. 4A–4B illustrate the connector apparatus of the present invention in the form of a children's building block toy.
Figure 4B:
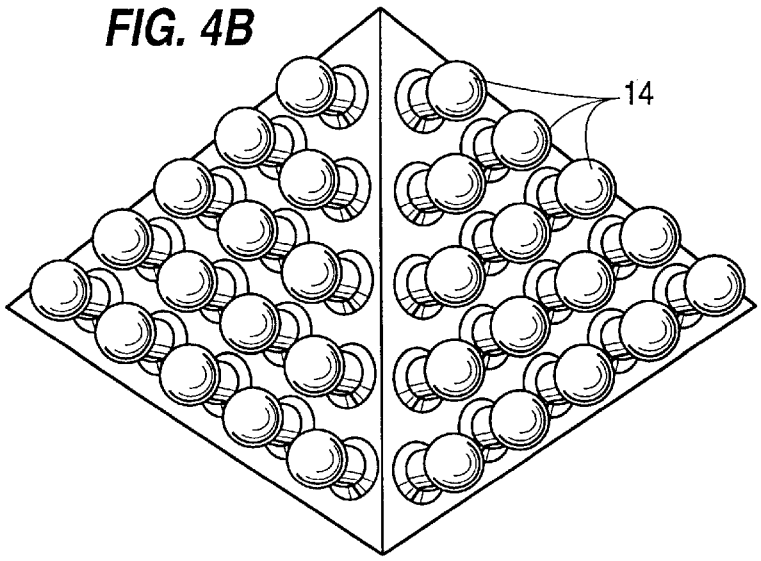

Application of the invention as a connector extends to many fields and technologies. FIGS. 4A and 4B illustrate one of the many embodiments as it depicts a children's toy building block system. In such an embodiment, the sides of the blocks (which are depicted as a dumbbell in FIG. 4A and a pyramid in FIG. 4B, but which may be of any shape) are covered with the matrix of male protrusions 14 so that other such blocks can be connected thereto. The shape of the blocks may be varied so long as there is sufficient surface area for engagement. In short the invention has application in any field and use where conventional connectors are found. For example, and without be limiting in any way, the invention has use in such diverse applications as a wall mounting system for telephones, an automobile cellular phone holder, a cyclist water bottle holder, an arrow holster for a bow, an airplane and boat navigation device holder, tackle and box latches, children's belts, suspenders, bracelets, footwear, a lawn and game dodecahedral "ball" with its surface covered with the matrix of the present invention to be aimed at and thrown towards a bulls eye board covered with the matrix of the present invention.

Although the present invention has been described with reference to preferred embodiments, workers skilled in the art will recognize that changes may be made in form and detail without departing from the spirit and scope of the invention.

What is claimed is:

1. A symmetrical and uniform connector matrix adaptable for releasable engagement to a second symmetrical and uniform matrix, comprising:

a planar base;

a plurality of protrusions for releasable, frictional engagement with protrusions on the second matrix, the plurality of protrusions extending outward from the base and being oriented on the base to form a matrix having a plurality of lateral and longitudinal rows wherein a distance $C_L$ is the same between centers of both laterally adjacent and longitudinally adjacent male protrusions and wherein a distance $C_D$ between centers of diagonally adjacent male protrusions is $1.41*C_L$, each protrusion including a head portion and a stem portion, the head portion having a height $K_H$ equal to $0.50*C_L$ and a diameter $K_D$ equal to $0.75*C_L$, the stem portion having a first end attached to the base and a second opposed end attached to the head portion, the stem portion having a height $S_H$ equal to $0.63*C_L$ and a diameter $S_D$ equal to $0.56*C_L$, wherein $C_L$, $C_D$, $K_H$, $K_D$, $S_H$, and $S_D$ each have a tolerance of ±6%, and wherein the total combined tolerance for $C_L$, $C_D$, $K_H$, $K_D$, $S_H$, and $S_D$ taken together is no more than ±6%.

2. The matrix of claim 1, wherein a thickness B of the base is greater than or equal to $0.37*C_L$.

3. The matrix of claim 1, further comprising a stem support flange attached to the base around the first end of each stem portion.

4. The matrix of claim 3, wherein a height $F_H$ of each stem support flange is $0.13*C_L$±6%, and wherein the total tolerance for $F_H$, $C_L$, $C_D$, $K_H$, $K_D$, $S_H$, and $S_D$ taken together is no more than ±6%.

5. The matrix of claim 4, wherein a diameter $F_D$ of each stem support flange is $0.75*C_L$6%, and wherein the total tolerance for $F_D$, $F_H$, $C_L$, $C_D$, $K_H$, $K_D$, $S_H$, and $S_D$ taken together is no more than ±6%.

6. The matrix of claim 1, wherein the head portion has a top section $K_T$ and a bottom section $K_B$, the top section $K_T$ having a height of $0.37*C_L$±6%.

7. The matrix of claim 6, wherein the bottom section $K_B$ has a height of $0.13*C_L$±6%.

8. The matrix of claim 7 wherein the total tolerance for $K_T$, $K_B$, $C_L$, $C_D$, $K_H$, $K_D$, $S_H$, and $S_D$ taken together is no more than ±6%.

9. A separable plastic male-to-male connector comprising:

a pair of connector units each including a planar base and a plurality of protrusions extending outward from the base and being oriented on the base so as to form a matrix having a plurality of lateral and longitudinal rows, wherein the matrix of protrusions on one of the pair of connector units is frictionally engageable with the matrix of the other of the pair of connector units, wherein a distance $C_{L1}$ is between centers of laterally adjacent male protrusions, and wherein a distance $C_{L2}$ is between centers of longitudinally adjacent male protrusions, each protrusion including a head portion and a stem portion, the head portion having a height $K_H$ equal to $0.50*(C_{L1}+C_{L2})/2$ and a diameter $K_D$ equal to $0.75*(C_{L1}+C_{L2})/2$, the stem portion having a first end attached to the base and a second opposed end attached to the head portion, the stem portion having a height $S_H$ equal to $0.63*(C_{L1}+C_{L2})/2$ and a diameter $S_D$ equal to $0.56*(C_{L1}+C_{L2})/2$, wherein $C_{L1}$, $C_{L2}$, $K_H$, $K_D$, $S_H$, and $S_D$ each have a tolerance of ±6%, and where the total combined tolerance for $C_{L1}$, $C_{L2}$, $K_H$, $K_D$, $S_H$, and $S_D$ taken together is no more than ±6%.

10. The connector of claim 9, wherein a thickness B of the base is greater than or equal to $0.37*(C_{L1}+C_{L2})/2$.

11. The connector of claim 9, further comprising a stem support flange attached to the base around the first end of each stem portion.

12. The connector of claim 11, wherein a height $F_H$ of each stem support flange is $0.13*(C_{L1}+C_{L2})/2$±6%, and wherein the total tolerance for $F_H$ $C_{L1}$, $C_{L2}$, $K_H$, $K_D$, $S_H$, and $S_D$ taken together is no more than ±6%.

13. The connector of claim 12, wherein a diameter $F_D$ of each stem support flange is $0.75*(C_{L1}+C_{L2})/2$±6%, and wherein the total tolerance for $F_D$, $F_H$, $C_{L1}$, $C_{L2}$, $K_H$, $K_D$, $S_H$, and $S_D$ taken together is no more than ±6%.

14. The connector of claim 9, wherein the head portion has a top section $K_T$ and a bottom section $K_B$, the top section $K_T$ having a height of $0.37*(C_{L1}+C_{L2})/2$±6%.

15. The connector of claim 14, wherein the bottom section $K_B$ has a height of $0.13*(C_{L1}+C_{L2})/2$±6%.

16. The connector of claim 15 wherein the total tolerance for $K_T$, $K_B$, $C_{L1}$, $C_{L2}$, $K_H$, $K_D$, $S_H$, and $S_D$ taken together is no more than ±6%.

17. The connector of claim 9, wherein a distance $C_D$ between centers of diagonally adjacent male protrusions is $1.41*C_L$.

18. The matrix of claim 9, wherein $C_L$ has a value greater than 0.125 inch.

19. The connector of claim 9, wherein $C_L$ has a value greater than 0.125 inch.

* * * * *